United States Patent [19]

Beun

[11] Patent Number: 4,736,649

[45] Date of Patent: Apr. 12, 1988

[54] TOOL OPERATED PUSHBUTTON MECHANISM FOR CONTROLLING THE ACTUATION OF A PANEL-LATCHING SYSTEM

[75] Inventor: Roger A. Beun, Dunrobin, Canada

[73] Assignee: Northern Telecom Limited, Montreal, Canada

[21] Appl. No.: 3,682

[22] Filed: Jan. 15, 1987

[51] Int. Cl.[4] ..... G05G 1/04; E05B 3/00

[52] U.S. Cl. ..... 74/526; 70/208; 292/336.3

[58] Field of Search ..... 74/526; 70/208, 298, 70/141, 137, 81, 162, 168; 292/197, 234, DIG. 71, DIG. 38, 87, 80

[56] References Cited

U.S. PATENT DOCUMENTS

| | | | |
|---|---|---|---|
| 3,020,075 | 2/1962 | Johnstone et al. | 70/208 |
| 3,576,118 | 4/1971 | Doerrfeld | 70/208 |
| 3,797,870 | 3/1974 | Beckman | 70/208 |
| 3,958,821 | 5/1976 | Scalera | 70/208 |
| 4,554,807 | 11/1985 | Doless | 70/208 |
| 4,580,822 | 4/1986 | Fukumoto | 292/336.3 |
| 4,606,567 | 8/1986 | Kato et al. | 292/336.3 |

*Primary Examiner*—Gary L. Smith
*Assistant Examiner*—Vinh Luong
*Attorney, Agent, or Firm*—F. P. Turpin

[57] ABSTRACT

The mechanism comprises a pivotally mounted lever member having a pushbutton portion and having its free end adapted for engagement of the actuator in a panel-latching system. An annular lock cylinder is mounted transversely underneath the pushbutton portion and is provided with a slot adapted to accommodate a portion of the pushbutton portion. One end of the cylinder has its surface formed into a cavity having a predetermined pattern whereby the lock cylinder may be rotated only by engagement with a tool adapted to engage the patterned cavity. The cylinder is rotatable to at least first and second positions whereby in the first position, the lever member is allowed to engage the actuator and is prevented from engagement therewith in the second position.

12 Claims, 2 Drawing Sheets

TOOL OPERATED PUSHBUTTON MECHANISM FOR CONTROLLING THE ACTUATION OF A PANEL-LATCHING SYSTEM

FIELD OF THE INVENTION

This application relates generally to panel-latching systems for electronic equipment cabinets or the like and more particularly to a tool operated anti-tamper pushbutton for controlling the actuation of the latch rod in such latching systems.

BACKGROUND OF THE INVENTION

Contemporary telecommunications systems are increasingly being packaged in boxed housings that provide electromagnetic shielding of the equipment as well as limited access to the circuitry. However, it is an increasingly frequent requirement of operating companies that the doors to the cabinets or frames of equipment not be locked under lock and key since the loss or misplacement thereof could cause a serious delay in accessing the equipment in emergency situations. It is therefore a desirable feature of electronic equipment cabinets that they provide only restricted access through a locking mechanism but also that they may be unlocked with a tool normally carried by a craftsperson. It is therefore the intent of this invention to provide such a locking mechanism.

SUMMARY OF THE INVENTION

Some well-known panel latching systems include a spring loaded latch having a locking bar protruding through an edge of the door of the cabinet. The latch is operated by a pushbutton protruding through the panel edge of the door. The invention provides a mechanism which effectively replaces the conventional pushbutton with a lockable pushbutton mechanism which may be operated with a screwdriver-like tool and which may be economically moulded of a thermoplastic material. It is an additional feature of the invention that the lock cylinder of the pushbutton is continuously rotatable in either direction and provides tactile feedback to the operator when the locked and unlocked locations of the cylinder are reached.

In accordance with the invention, there is provided a tamper-proof pushbutton mechanism for controlling the operation of the actuator in a panel-latching system. The mechanism comprises a lever member having a first end adapted for engagement of the actuator and a second end pivotally secured to the panel. The lever member also comprises a pushbutton formation intermediate the first and second ends. An annular lock cylinder is mounted transversely underneath the pushbutton formation of the lever member and is provided with a slot adapted to accommodate a portion of the pushbutton formation. One end of the cylinder has at least a portion of its surface formed into a cavity having a predetermined pattern whereby the lock cylinder may be rotated only by engagement with a tool adapted to engage the patterned cavity. The cylinder is rotatable to first and second positions whereby in the first position, the portion of the pushbutton formation is allowed to enter the slot thereby to allow the first end of the lever to engage the actuator of the panel-latching system, and in the second position, the portion of the pusbutton formation is prevented from entering the cylinder slot thereby preventing the engagement of the actuator by the first end of the lever member.

In the preferred embodiment of the invention, the lever member and the lock cylinder are both mounted in a support structure adapted to be secured on the inside edge of a cabinet panel and the three pieces of the mechanism are moulded of a thermoplastic material.

BRIEF DESCRIPTION OF THE DRAWINGS

An embodiment of the invention will now be described in which.

DESCRIPTION OF THE PREFERRED EMBODIMENT

Figure 1:
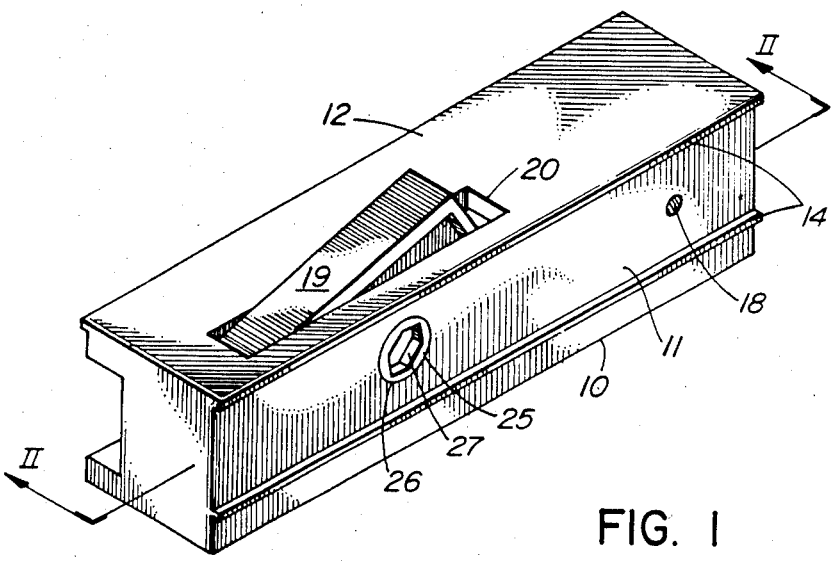
FIG. 1 is a perspective view of a pushbutton mechanism in accordance with the invention.
Figure 3:
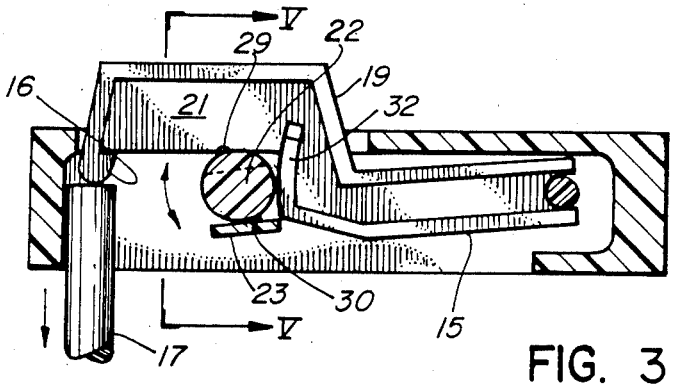
FIG. 3 is a cross-sectional view of the mechanism of FIG. 1 also taken at lines II—II but showing the lever member in its inoperable condition.
Figure 2:
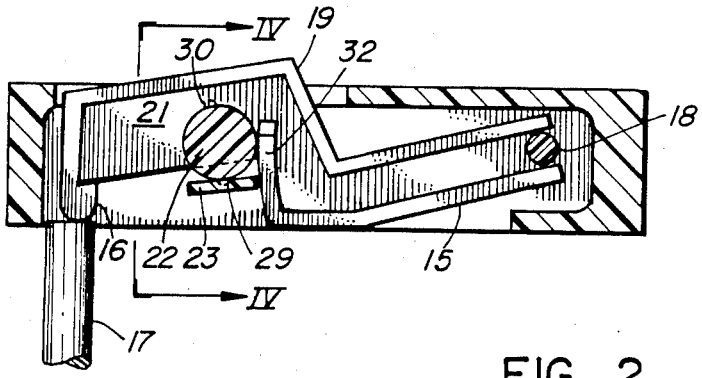
FIG. 2 is a cross-sectional view of the mechanism of FIG. 1 taken at lines II—II.
Figure 5:
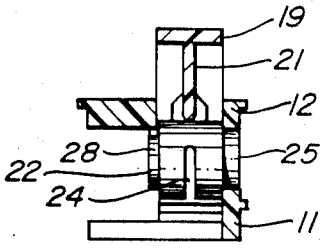
FIG. 5 is a cross-sectional view of the mechanism of FIG. 3 taken at lines IV—IV.
Figure 4:
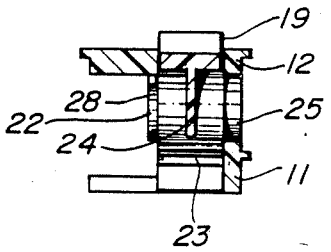
FIG. 4 is a cross-sectional view of the mechanism of FIG. 2 taken at lines IV—IV.
Figure 6:
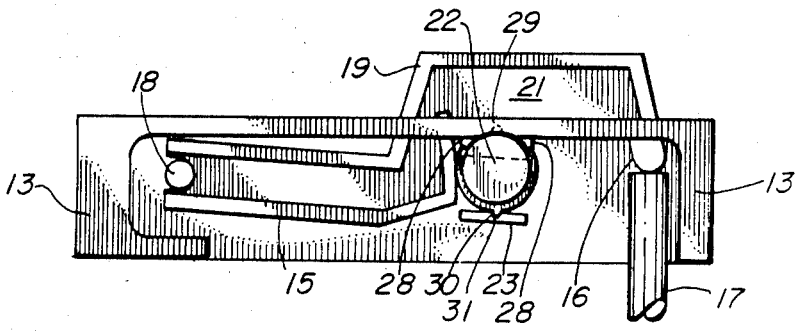
FIG. 6 is a rear view of the mechanism illustrated in FIG. 3.

The embodiment will be described in conjunction with FIGS. 1 to 6 which all relate to different views of the pushbutton mechanism of the invention.

The drawings illustrate a support structure 10 comprising a first wall 11 secured to a second wall 12 at approximately right angle thereto. The structure may be reinforced with end webs 13 and may be provided with ridges 14 along its length. The structure 10 may be mounted in the inside upper or lower corner of a housing panel by any convenient means such as screws or bolts. It is intended to replace the conventional pushbutton mechanism that operates the actuator or latch rod of a panel-latching system.

Mounted inside the support structure 10 is a lever member 15 having a first end 16 for engagement with the latch rod 17 of a panel-latching system (not shown). The rod 17 is usually resiliently biased towards the pushbutton mechanism. The other end of the lever member 15 is pivotally mounted on a pivot pin 18 secured to the wall 11. The lever member 15 is provided with a pushbutton formation 19 having its upper part protruding through a complementary shaped opening 20 in the wall 12 and its lower portion shaped as a relatively thin web 21.

A lock cylinder 22 is located beneath the pushbutton formation 19 and is supported by the walls 11 and 12 as well as a tab 23 secured to the wall 11. The cylinder 22 is a solid material provided with a slot 24 adapted to accommodate at least a portion of the web 21. One end of the cylinder 22 has a chamfered end portion 25 inserted into a hole 26 of the wall 11. The outer end surface 25 is provided with a cavity having a predetermined pattern 27 such as a polygon, slot, cross, or any other pattern into which a tool (not shown) having a complementary pattern may be inserted for rotation of the cylinder 22. The other end of the cylinder 22 also has a chamfered portion for engagement with the wall 12 which may be provided with protrusions 28 to better secure the cylinder in place. The outside edge of the cylinder periphery is provided with a pair of diametrically disposed projections 29 and 30 and the tab 23 is provided with a complementary-shaped recess 31. The lever member 19 may be provided with an arcuate web portion 32 to provide increased stability of the member 19.

The support structure 10, the lever member and the lock cylinder may each be conveniently moulded from a thermoplastic material. The mechanism may then be assembled by inserting the lever member 15 in the support structure 10 through the opening 20, the end of the member 15 located on the pivot pin 18, and the member 15 secured in place by positioning one end of the lock cylinder 22 into the opening 26 of the vertical wall 11 and negotiating its other end in place through a slight flexure of the wall 12.

In view of its cylindrical shape, the lock cylinder may be rotated continuously in one or the other direction. When the projection 29 is in the recess 31 of tab 23, the web portion 21 is aligned with the slot 24 and pressure on the pushbutton portion 19 causes the web portion 21 to enter the slot 24 and the latch rod 17 to be contacted by the first end of the lever member 15 to thereby actuate the panel-latching system. Alternatively, when the lock cylinder is rotated so that the projection 30 is in the recess 31 of the tab 23, the web portion 21 is prevented from entering the slot 24 thus precluding the panel-latching system from being actuated. Because the movement of the projections 29 and 30 into and out of the recess 31 of tab 23 requires a slight flexure of the tab 23, tactile feedback is returned to the operator to confirm the setting of the lock cylinder.

Although the preferred embodiment of the invention was realized using components of moulded plastic material, it is entirely possible to use other materials to realize a similar mechanism without departing from the scope and spirit of the invention.

What is claimed is:

1. A tamper-proof pushbutton mechanism for controlling the operation of the actuator in a panel-latching system comprising, a support structure adapted to be secured on the inside edge of a panel, the structure comprising a first wall secured to a second wall at approximately right angle thereto, a lever member having a first end adapted for engagement of the actuator and a second end pivotally engaging a pivot pin secured to the inside surface of the first wall, the lever member also comprising a pushbutton formation intermediate the first and second end, and means located under the pushbutton formation, said means being rotatable to first and second positions and comprising an annular lock cylinder mounted transversely to the lever member, the cylinder having a slot cut partially therethrough in a direction transverse to the axis of the cylinder, the slot being adapted to accommodate a portion of said pushbutton formation whereby in said first position, said portion of the pushbutton formation is allowed to enter said slot and in said second position, said portion of the pushbutton formation is prevented from entering said slot.

2. A tamper-proof pushbutton mechanism as defined in claim 1 wherein one end of the lock cylinder has at least a portion of its surface formed into a cavity having a predetermined pattern whereby the lock cylinder may be rotated only by engagement with a tool adapted to engage said one end.

3. A tamper-proof pushbutton mechanism as defined in claim 2 wherein said first and second positions are approximately one hundred and eighty degrees apart.

4. A tamper-proof pushbutton mechanism as defined in claim 3 wherein the lock cylinder comprises means for indicating the location of said first and second positions.

5. A tamper-proof pushbutton mechanism as defined in claim 4 wherein said indicating means comprises a pair of projections diametrically located on said lock cylinder, at least one of the projections being adapted to engage a complementary recess in in a tab projecting out from the first wall.

6. A tamper-proof pushbutton for actuating the actuator of a panel-latching system as defined in claim 5 wherein the lock cylinder is continuously rotatable in one or the other direction.

7. A tamper-proof pushbutton mechanism for controlling the operation of the actuator in a panel-latching system comprising, a support structure adapted to be secured on the inside edge of a panel, the structure comprising a first wall secured to a second wall at approximately right angle thereto, a lever member having a first end for engagement of the said actuator and a second end pivotally engaging a pivot pin secured to the inside surface of the first wall, the lever member further comprising a pushbutton formation intermediate the first and second end, the pushbutton formation protruding through a complementary-shaped hole through the second wall, an annular lock cylinder rotatably mounted in the support structure at a location underneath said pushbutton formation, the lock cylinder comprising a solid material having a slot therein for accommodating a portion of the pushbutton formation, one end of the cylinder having its surface formed into a cavity having a predetermined pattern and the first wall being provided with a hole for allowing access to said one end of the cylinder with a tool adapted to engage said one end of the cylinder whereby it may be rotated to two different positions to alternatively allow or prevent said portion of the pushbutton formation from entering said slot thereby to allow or prevent actuation of the actuator.

8. A tamper-proof pushbutton mechanism as defined in claim 7 wherein the support structure, the lever and the annular lock cylinder are each moulded of a thermoplastic material.

9. A tamper-proof pushbutton mechanism as defined in claim 8 wherein the lock cylinder is held in the support structure by having said one end projecting into said hole of the first wall, and its other end supported by a portion of the second wall and a tab projecting out from the first wall.

10. A tamper-proof pushbutton mechanism as defined in claim 9 wherein the lever member is held in the support structure by the lock cylinder the latter held resiliently by the support structure.

11. A tamper-proof pushbutton mechanism for controlling the operation of the actuator in a panel-latching system comprising, a support structure adapted to be secured on the inside edge of a panel, the structure comprising a first wall secured to a second wall at approximately right angle thereto, a lever member having a first end for engagement of the said actuator and a second end pivotally engaging a pivot pin secured to the inside surface of the first wall, the lever member further comprising a pushbutton formation intermediate the first and second end, the pushbutton formation protruding through a complementary-shaped hole through the second wall, an annular lock cylinder rotatably mounted in the support structure at a location underneath said pushbutton formation, the lock cylinder comprising a solid material having a slot therein for accommodating a portion of the pushbutton formation, one end of the cylinder having its surface formed into a cavity having a predetermined pattern and the first wall being provided with a hole for allowing access to said one end of the cylinder, with a tool adapted to engage said one end of the cylinder, the cylinder being held in the support structure by having said one end projecting into said hole of the first wall and its other end supported by a portion of the second wall and a tab projecting out from the first wall, and said other end of the lock cylinder being provided with a pair of diametrically disposed projections whereby the mating of a complementary recess in said tab with one and another of the projections corresponds to said first and second positions.

12. A tamper-proof pushbutton mechanism as defined in claim 11 wherein the lock cylinder is continuously rotatable in either direction.

* * * * *